United States Patent [19]

Harwell

[11] Patent Number: 4,576,331

[45] Date of Patent: Mar. 18, 1986

[54] BOOSTER FAN AND AIR DEFLECTOR FOR FLOOR VENTS

[76] Inventor: Betty L. Harwell, 9643 E. 26th St., Tulsa, Okla. 74129

[21] Appl. No.: 673,602

[22] Filed: Nov. 21, 1984

[51] Int. Cl.[4] ..... F24F 7/007

[52] U.S. Cl. ..... 236/49; 98/39.1; 98/40.28; 98/103

[58] Field of Search ..... 98/39, 40 V, 43 R, 101, 98/103; 236/49; 237/46, 50

[56] References Cited

U.S. PATENT DOCUMENTS

| | | | |
|---|---|---|---|
| 770,074 | 9/1904 | Kilmer et al. . | |
| 1,273,753 | 7/1918 | Eelhart | 98/103 |
| 1,426,900 | 8/1922 | Heal | 98/103 X |
| 1,645,140 | 10/1927 | Hersbruck . | |
| 1,743,994 | 1/1930 | Waterbury . | |
| 1,843,786 | 2/1932 | Robinson . | |
| 1,917,043 | 7/1933 | Lewis | 98/40 V X |
| 2,135,461 | 11/1938 | Woolley . | |
| 2,972,941 | 2/1961 | Bennett | 98/101 |
| 2,996,972 | 8/1961 | Johansson | 98/40 V |

*Primary Examiner*—Harold Joyce

*Attorney, Agent, or Firm*—Head, Johnson & Stevenson

[57] ABSTRACT

A booster fan and deflector for placing over a forced air heating/air conditioning floor vent to deliver more cool air in warm weather and more warm air in cold weather. The booster fan and deflector comprises a low profile plastic housing adapted to sit on a rectangular floor vent and blow air from the furnace air duct through a circular rotatable deflector on the top. A thermostatic switch is employed to automatically turn the fan motor on and off.

1 Claim, 5 Drawing Figures

BOOSTER FAN AND AIR DEFLECTOR FOR FLOOR VENTS

BACKGROUND OF THE INVENTION

1. Field of the Invention

This invention relates to a booster fan and air deflector adapted to rest on a conventional floor furnace vent. More specifically, the invention relates to a low profile plastic housing containing a thermostatically controlled electric fan and motor with a rotatable air deflector on the top of the housing which is intended to rest on a forced air heating/air conditioning floor vent to assist in moving greater volumes of air through the vent.

2. Description of the Prior Art

It is generally acknowledged in the heating and air conditioning industry that the concept of zone heating, wherein a single dwelling is equipped with multiple forced air heating/air conditioning units dedicated to separate portions or zones of the dwelling, represents a more economical and efficient operating method relative to a single centralized unit. However, the additional capital expenditure for a second or third furnace and air conditioner is not always economically justified. Therefore, it would be desirable if an inexpensive yet reliable method of selectively delivering more air to a desired zone of a dwelling equipped with a single centralized contemporary heating/air conditioning unit was available. However, to approach the operational characteristics of zone heating and air conditioning using a booster fan or the like in connection with a single centralized unit represents a pragmatic problem in that such a booster fan system would ideally have to be automatic and selective with respect to which air outlet vent is being assisted.

Prior to the present invention and to the best knowledge of the inventor, no highly portable, yet automatic booster fan specifically compatible with conventional floor furnace bents have been available. However, booster fans for use in conjunction with heating units have generally been employed in the prior art. For example, U.S. Pat. No. 2,135,461 discloses the use of a squirrel cage blower resting on top of a steam radiator and window sill above the radiator for circulating fresh air through the radiator. Also, U.S. Pat. No. 1,843,786 proposes the use of a booster fan in an air duct from a hot air register; however, no automatic sensing or control of the air movement is proposed. Other non-automated booster fans can be found in U.S. Pat. Nos. 1,743,994; 1,645,140 and 770,074.

SUMMARY OF THE INVENTION

In view of the prior art and the problems associated with selectively delivering more air to a given room to either cool or warm the room, I have discovered a booster fan and deflector for floor vents comprising:

(a) an essentially rectangular open grilled bottom member with a plurality of substantially vertical support legs with openings therebetween wherein the legs are attached to the underside of the outer perimeter of and extend downwardly from the rectangular bottom member and wherein the bottom member is adapted to rest on the legs suspended above and substantially covering a furnace floor vent;

(b) a first substantially vertical sidewall attached along and extending upwardly from one long side of the rectangular bottom member;

(c) a second substantially vertical sidewall attached along and extending upwardly from the other long side of the rectangular bottom member;

(d) a first inwardly and upwardly sloped sidewall attached along one of the short sides of the perimeter of the bottom member;

(e) a second inwardly and upwardly sloped sidewall attached along the other short side of the perimeter of the bottom member;

(f) an essentially square, horizontal top member attached along the upper edges of the sidewalls wherein the top member contains a circular opening;

(g) an essentially circular rotatable grill deflector means operatively attached to the opening in the top member wherein the parallel bars making up the grill deflector means are sloped such as to deflect air passing through the grill deflector means;

(h) an electric fan and motor means operatively positioned within the booster fan for moving air from the floor furnace vent through the circular rotatable grill deflector means; and (i) a thermostatic switch means responsive to temperature wherein the switch means turn the electric fan and motor means on and off depending on the temperature of the air passing through the booster fan.

It is an object of the present invention to provide a portable booster fan/deflector that can be selectively placed on a conventional furnace/air conditioning floor vent. It is an associated object to provide such a booster fan/deflector that is thermostatically controlled and will automatically turn on and off according to a change in temperature of the air passing through the floor vent. Fulfillment of these objects and the presence and fulfillment of additional objects will become apparent upon complete reading of the specification and claims taken in conjunction with the attached drawings.

DESCRIPTION OF THE PREFERRED EMBODIMENTS

Figure 1:
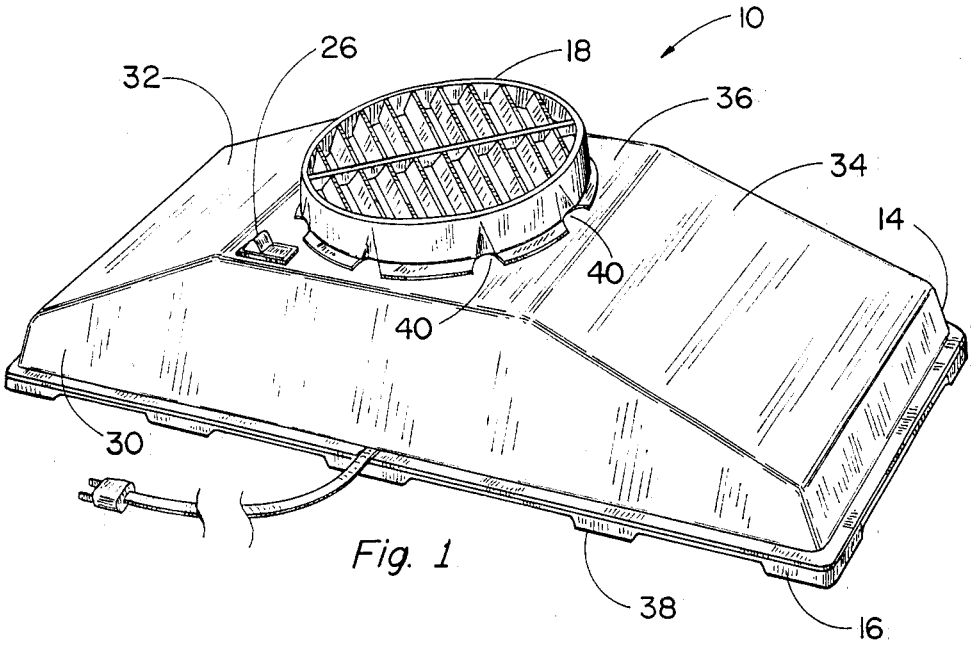
FIG. 1 illustrates a perspective view of the booster fan/deflector according to the present invention.
Figure 2:
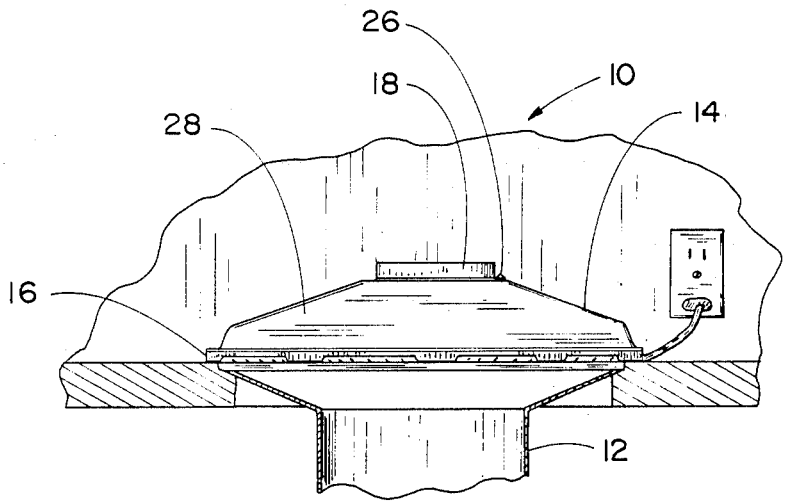
FIG. 2 is a partial cut-away view of the booster fan of FIG. 1 resting on a conventional furnace floor vent.

The thermostatically controlled floor vent booster fan according to the present invention, how it functions, how it differs from prior art devices and the advantages associated with its use can perhaps be best explained and understood by reference to the drawings. FIG. 1 illustrates a booster fan according to the present invention, generally designated by the numeral 10. FIG. 2 illustrates the booster fan 10 resting directly on a conventional furnace floor vent 12. As illustrated in these figures, the booster fan 10 is made up of a low profile housing 14 supported on an open grid with legs 16 that allow for some room air circulation in addition to the air flow directed from beneath through the floor vent 12. On top of the housing 14 is a circular vent 18 that can be rotated such as to direct the air exiting the vent 18 as desired. An internal electrical motor 20 and fan 22 (see FIGS. 4 and 5) is powered by a conventional electrical connection 24 and a selection switch 26 on the top surface of the housing.

Figure 3:
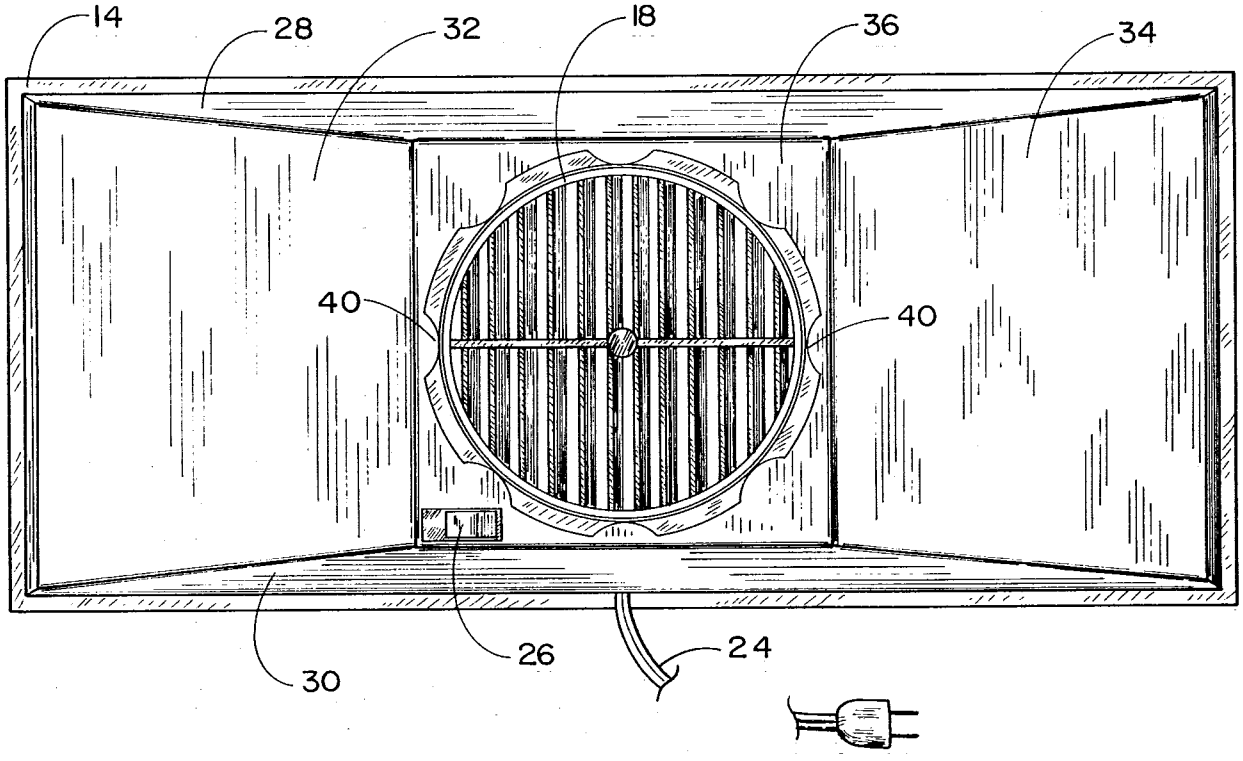
FIG. 3 is a top view of the booster fan of FIG. 1.

As further illustrated in the top view of FIG. 3, the low profile housing 14 is made up of a pair of substantially vertical sidewalls 28 and 30 extending upwardly from the leg supported grill 16 along the long side of the housing and a pair of inwardly and upwardly sloping sidewalls 32 and 34 along the short side of the housing terminating in a substantially square horizontal flat surface 36 on the top of the housing 14. Centrally located in the top surface 36 is the circular rotatable grill 18 which is equipped with a plurality of finger grips 40 around the outer perimeter to assist with the manual positioning of the grill 18. In this manner, the direction of the air flow exiting the booster vent 10 can be selected as desired. Also, the top surface 36 of the housing 14 is equipped (in this specific embodiment) with the three-way electrical switch 26 for turning the fan on and off or selecting the automatic thermostatically controlled mode of operation, as explained later.

Figure 4:
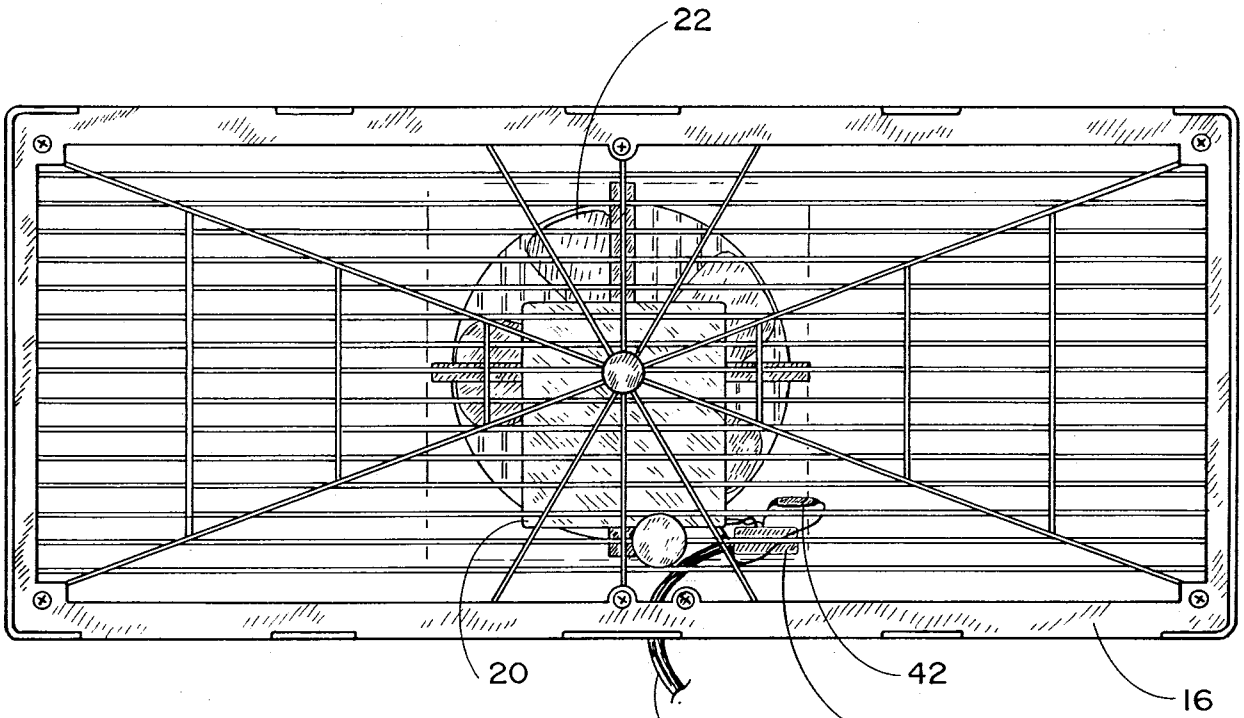
FIG. 4 is a bottom view of the booster fan of FIG. 1.

As illustrated from the bottom view of FIG. 4, the support grill 16 is essentially an open grid structure allowing air exiting the floor vent to enter the underside of the booster fan 10. Since the support grill 16 is elevated on legs 38, the booster fan 10 does not form an air seal around the floor vent, thus allowing air circulating under the sidewalls of the booster fan as well as through the top vent 18.

Figure 5:
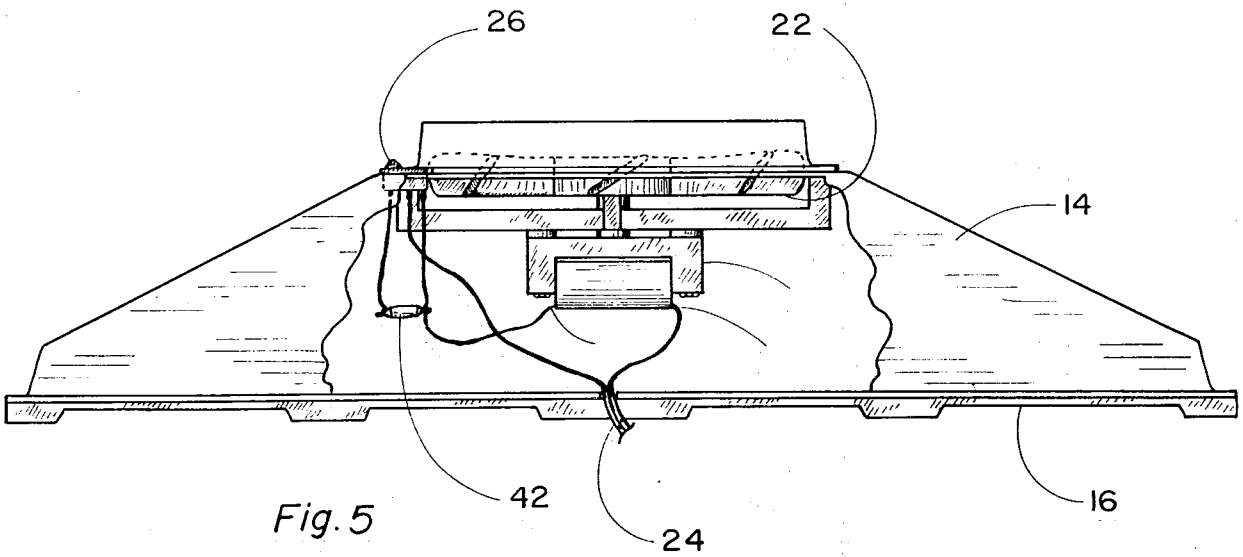
FIG. 5 is a partial cut-away side view of the booster fan of FIG. 1.

As further illustrated in FIG. 3 and as can be seen in FIG. 5, the electric motor 20 is centrally positioned within the underside of the booster fan housing such as to drive the fan 22 positioned directly below the circular rotatable grill 18. As seen in FIG. 5, the electric power leads are directed to one side 40 of the electric motor and to the three-way switch 26. When switch 26 is in the automatic mode, the electric current is directed through thermostatic switch 42 before being directed to the other side 44 of the electric motor 20. In this manner, when switch 26 is in the central position, the fan and motor are off; when in the right position (relative to FIG. 5), the fan and motor are continuously on and when in the left position, the fan and motor are on only when a preselected temperature is achieved, thus closing the thermostatic switch 42. In this manner, the booster fan can be used manually or automatically. In the automatic mode, the selection of the thermostatic switch determines how the booster fan is to be used. For example, a switch that turns on at a temperature a few degrees in excess of room temperature will be useful as a booster fan during cold weather; that is, it will assist circulation of the hot air exiting the floor furnace vent once the temperature begins to rise. Similarly, a switch that turns on a few degrees below room temperature will be useful as a booster fan for an air conditioning system. The combination of both types of switches will allow for the booster fan to provide additional air movement during heating and air conditioning modes of operation.

Preferably, the major components of the booster fan according to the present invention are to be constructed out of molded thermoplastic. Generally, this can be achieved by fabricating the entire booster fan out of only three separate components (i.e., the support grill 16 with legs, the rotatable grill 18 and the rest of the sidewalls and top surfaces of the booster fan housing as a single unit). To assemble the unit, the rotatable plastic grill 18 is merely snapped into the opening in the top of the booster fan housing, the fan and motor, wiring and switch are attached to the inside of the booster fan housing and the bottom grill is then fastened to the lower lip of the sidewalls of the booster fan housing.

The selection of plastic to fabricate the components can generally be any polymeric material compatible with the temperature ranges experienced during operation of the booster fan. This would include by way of example, but not limited thereto, various polyolefins, impact polystyrene, ABS, polycarbonates, various high temperature vinyls and acrulics and the like. Preferably, the booster fan is fabricated out of ABS.

The advantages associated with the thermostatically controlled floor vent booster fan according to the present invention are considered numerous and significant. First and foremost, the booster fan represents a relatively inexpensive, convenient, reliable, yet safe device for assisting air movement exiting a floor vent. The relatively low profile of the booster fan housing is considered esthetically pleasing, functionally consistent with the intended use and relatively safe. The fact that the device is not intended to be attached permanently to a floor vent allows the user to reposition the device from vent to vent as well as from room to room, thus making the device a relatively versatile unit. This portability also allows the user to employ the device such as to simulate zone heating and air conditioning even when only one centralized unit is present in the dwelling.

Having thus described the invention with a certain degree of particularity, it is manifest that many changes may be made in the details of construction and the arrangement of components without departing from the spirit and scope of this disclosure. Therefore, it is to be understood that the invention is not limited to the embodiment set forth herein for the purposes of exemplification, but is to be limited only by the scope of the attached claim, including a full range of equivalents to which each element thereof is entitled.

I claim:

1. A booster fan and deflector for floor vents comprising:

(a) an essentially rectangular open grilled bottom member with a plurality of substantially vertical support legs with openings therebetween wherein the legs are attached to the underside of the outer perimeter of and extend downwardly from said rectangular bottom member and wherein said bottom member is adapted to rest on said legs suspended above and substantially covering a furnace floor vent;

(b) a first substantially vertical sidewall attached along and extending upwardly from one long side of said rectangular bottom member;

(c) a second substantially vertical sidewall attached along and extending upwardly from the other long side of said rectangular bottom member;

(d) a first inwardly and upwardly sloped sidewall attached along one of the short sides of the perimeter of said bottom member;

(e) a second inwardly and upwardly sloped sidewall attached along the other short side of the perimeter of said bottom member;

(f) an essentially square, horizontal top member attached along the upper edges of said sidewalls wherein said top member contains a circular opening;

(g) an essentially circular rotatable grill deflector means operatively attached to said opening in said top member wherein the parallel bars making up said grill deflector means are sloped such as to deflect air passing through said grill deflector means;

(h) an electric fan and motor means operatively positioned within said booster fan for moving air from the floor furnace vent through said circular rotatable grill deflector means; and (i) a thermostatic switch means responsive to temperature wherein said switch means turn said electric fan and motor means on and off depending on the temperature of the air passing through said booster fan.

* * * * *